United States Patent [19]

Tsakiris

[11] 4,428,169

[45] Jan. 31, 1984

[54] VAULTED DOME SKYLIGHT

[75] Inventor: Nicholas G. Tsakiris, South Berwick, Me.

[73] Assignee: Wasco Products, Inc., Sanford, Me.

[21] Appl. No.: 353,048

[22] Filed: Mar. 1, 1982

[51] Int. Cl.[3] ..... E04B 7/18

[52] U.S. Cl. ..... 52/200

[58] Field of Search ..... 52/200, 400, 397, 204, 52/92, 398

[56] References Cited

U.S. PATENT DOCUMENTS 3,762,120 10/1973 Janssen ..... 52/200
3,791,088 2/1974 Sandow et al. ..... 52/200
4,073,097 2/1978 Jentoft et al. ..... 52/200 X
4,327,532 5/1982 Matthews ..... 52/200 X

FOREIGN PATENT DOCUMENTS 554376 4/1977 U.S.S.R. ..... 52/200

*Primary Examiner*—J. Karl Bell
*Attorney, Agent, or Firm*—Wolf, Greenfield & Sacks

[57] ABSTRACT

A vaulted dome skylight for covering an opening in a building wherein the opening is generally defined by a support curb. The skylight includes a sill of single piece construction secured to the support curb, inner and outer domes and a retaining means for securing the domes over the sill. The sill has a base and inner and outer angularly disposed channel members for respectfully receiving the inner and outer domes.

6 Claims, 7 Drawing Figures

VAULTED DOME SKYLIGHT

BACKGROUND OF THE INVENTION

The present invention relates in general to skylights and pertains, more particularly, to a vaulted dome skylight which is described herein in two different embodiments.

Among the objects of the present invention is to provide an improved skylight of the vaulted dome type and particularly one that is of relatively simple construction.

Another object of the present invention is to provide a vaulted dome skylight employing a sill of improved construction and in particular one of single piece design.

Still another object of the present invention is to provide an improved vaulted dome skylight which is readily adapted for use with either a single or a double glazing.

A further object of the present invention is to provide an improved vaulted dome skylight which is adapted for use with building curbs of various size.

SUMMARY OF THE INVENTION

To accomplish the foregoing and other object of the present invention there is provided a vaulted dome skylight adapted to cover an opening in a building. The opening may be defined by a support curb usually extending in a rectangular form. The vaulted dome skylight comprises a single piece sill and means for securing the sill to the support curb. There are preferably provided both inner and outer domes although the inner dome is optional. A retaining means is provided for securing the domes over the sill. The sill has a base which is secured to the curb and inner and outer angularly disposed channel members for respectively receiving the inner and outer domes. In the embodiments described herein the inner and outer domes each comprise a plurality of dome sections. There is also provided an intermediate support rib for supporting adjacent dome sections. This intermediate support rib extends arcuately from side to side of the skylight. There is preferably a cap band secured to the intermediate support rib and also gasket means are provided at the support rib between the domes. In order to properly support the intermediate support rib there is provided a support member and means securing this member to the sill to maintain the support member in a position to hold the intermediate support rib in place. The domes have end flanges and include a seat gasket at the end flanges disposed under these flanges between the domes and the skylight still thereunder. There is also provided a retainer intercoupling between the sill and dome flanges. There is described herein two basic embodiments of the present invention, one in which the end dome sections are arcuate and another in which there is provided end plates and associated end retainer means.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 4:
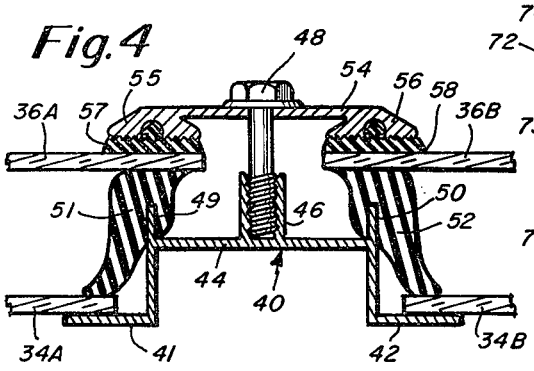
FIG. 4 is a cross sectional view taken along lines 4—4 of FIG. 1 showing the cross section of the intermediate support rib.
Figure 5:
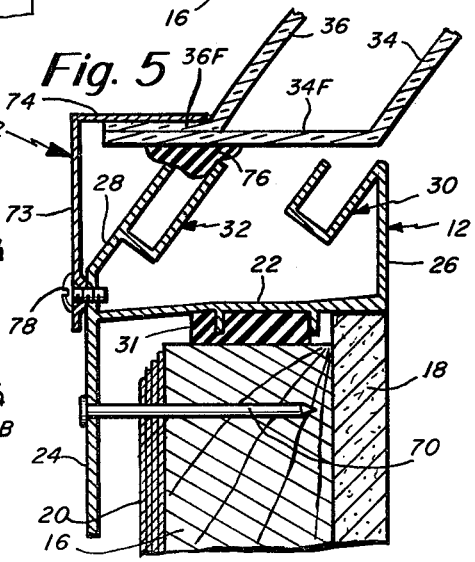
FIG. 5 is a cross sectional view taken along lines 5—5 of FIG. 1 showing the end curb section.
Figure 6:
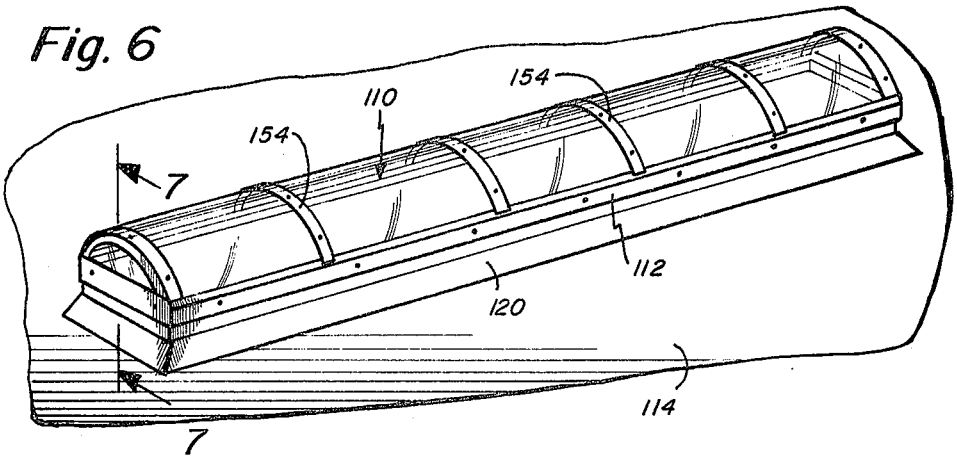
FIG. 6 is a perspective view showing an alternate embodiment of the present invention.
Figure 7:
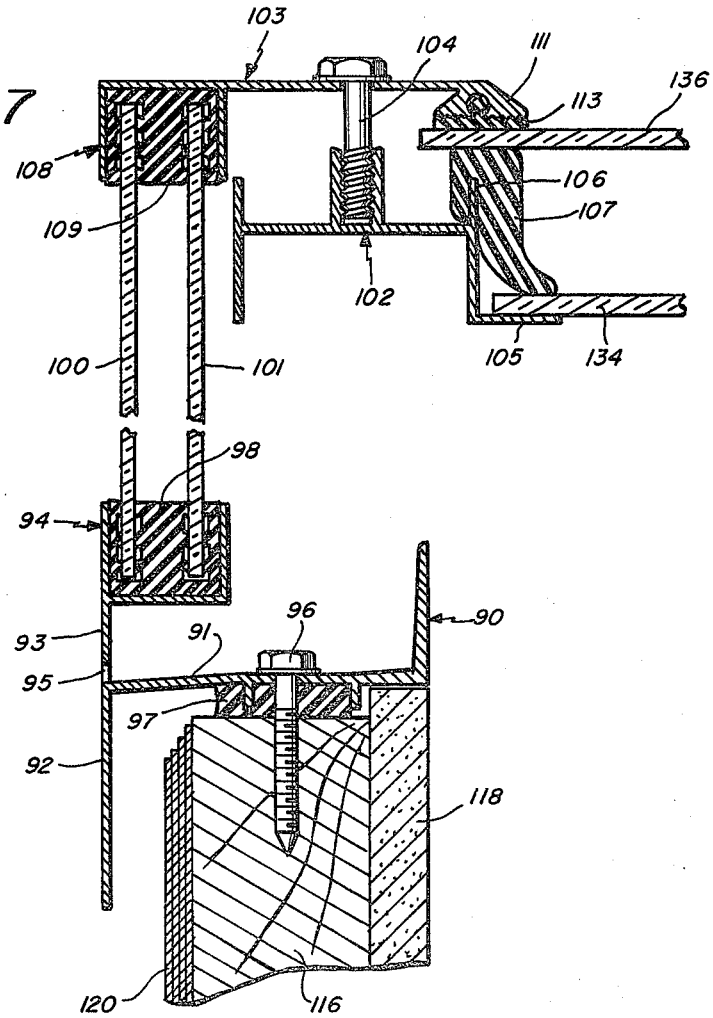
FIG. 7 is a cross sectional view taken along lines 7—7 of FIG. 6 showing the different end configuration of this alternate embodiment.

Referring to the drawing, there is shown a first embodiment of the invention in FIGS. 1–5 and a second embodiment in FIGS. 6 and 7. The first A embodiment includes end domed sections that form an arc to the end walls. In the embodiment of FIG. 6 all domed sections are alike even the end sections but there is provided a separate end glazing or pair of glazings.

Figure 1:
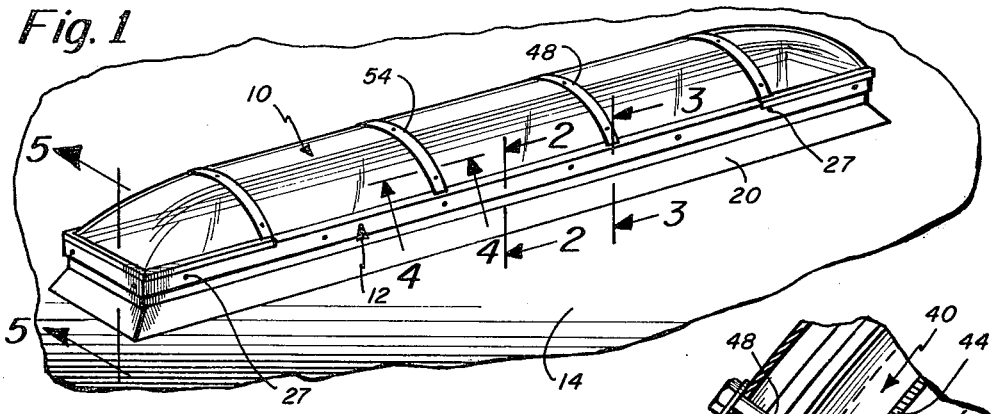
FIG. 1 is a perspective view showing a first embodiment of the vaulted dome skylight of the present invention.
Figure 2:
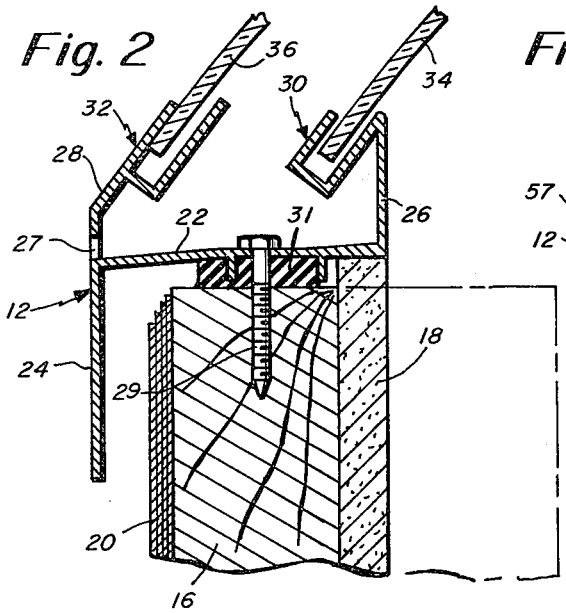
FIG. 2 is a cross sectional view taken along lines 2—2 of FIG. 1 showing th sill cross section.
Figure 3:
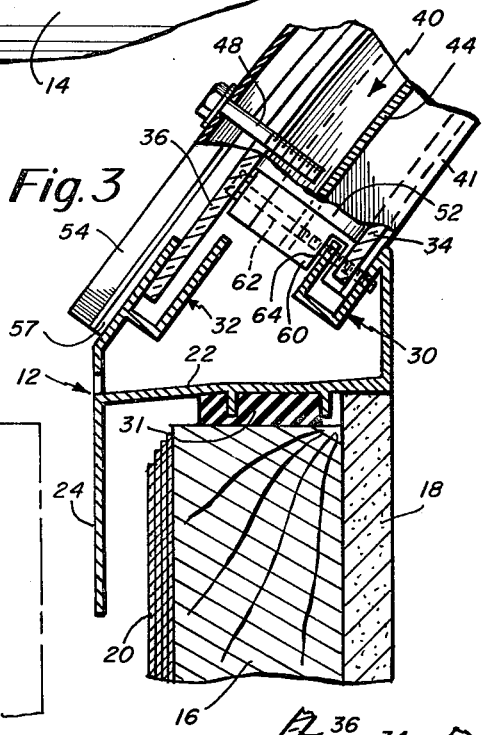
FIG. 3 is a cross sectional view taken along lines 3—3 of FIG. 1 taken at an intermediate support rib.

In the first embodiment illustrated in FIGS. 1–5, there is provided a continuous domed skylight that generally comprises a dome 10 adapted to engage with a single piece still 12. In FIG. 1 the skylight is shown secured about an opening in a building roof 14. FIGS. 2, 3 and 5 illustrate a wooden curb 16 which may typically have on the inside a finish material 18 which may be a finish plaster or sheet rock, and flashing 20. FIG. 1 also illustrates a flashing 20.

The sill 12 comprises a base 22, a downwardly depending leg 24, and inner and outer walls 26 and 28. Integral channel members 30 and 32 are respectfully connected to the top of the walls 26 and 28. As illustrated in FIG. 2, these channel members are for supporting the respective inner and outer domes 34 and 36. The domes 34 and 36 are provided in sections as illustrated in FIG. 1. The inner dome 34 may be optionally provided. Both of the domes are constructed of an acrylic plastic. The sill 12 is preferably constructed of extruded aluminum.

To provide for the removal of condensation from the skylight, weepholes 27 are provided preferably in the wall 28.

As illustrated in FIG. 2, the sill is suitably anchored to the curb. A minimum of ¼ inch diameter anchor 29 is employed. There is also preferably provided a continuous mastic material 31 between the sill and the curb. The mastic material 31 is typically applied at the job site by the installer. The anchor 29 may be in the form of a lag bolt with appropriate receiving shield or could be a spike.

FIG. 3 illustrates the structure of the skylight at the intersection between the sill and the intermediate supports. More particularly, an also with reference to FIG. 4, there is provided an intermediate support rib 40 having lower support flanges 41 and 42 and an intermediate support wall 44. The wall 44 supports a centrally disposed member 46 apertured to receive the securing bolt 48. The wall 44 also carries upwardly extending ears 49 and 50. These ears engage and secure respective divider gaskets 51 and 52. The gaskets 51 and 52 extend between the domes. In FIG. 4 the gaskets are illustrated extending on one side between inner and outer dome sections 34A and 36A, and the gasket on the other side extends between dome sections 34B and 36B. It is noted in FIG. 4 that the inner domes rest upon the flanges 41 and 42 and that the inner domes are slightly shorter in the dimension illustrated in FIG. 4. The cap bolt 48 is used for the purpose of securing the dome sections in place. For this purpose there is provided a cap band 54 having oppositely disposed feet 55 and 56 for supporting respective gaskets 57 and 58 and this is the way a weather tight seal is provided between the cap band and the outer dome. The bolts 48 are hex head stainless steel bolts used in conjunction with gasketed stainless steel washers.

As illustrated in FIG. 3, it is noted that the cap band 54 extends slightly beyond the outer dome 36. Upon tightening of the bolt 48 the outer dome 36 is urged against the outer leg of the channel member 32 as clearly shown in FIG. 3. The end of the intermediate support rib 40 illustrated in FIG. 4, is supported in the manner illustrated in FIG. 3. This support includes a support member or post 60 which is secured by means of an elongated bolt 62 from the inner channel member 30 of the sill 12. The member 60 has a slot 64 which is used to position the member 60 relative to the sill. The slot 64 engages with one of the side legs of the channel 30. The aforementioned bolt 62 passes through the member 60 and may threadedly engage with the channel member 30. The member 60 is disposed between the different dome sections and thus does not interfere therewith. However, this member does provide a bottom limiting support for the intermediate support rib 40.

FIG. 5 illustrates the end of the skylight of FIG. 1. This end view illustrates the use of an anchor member 70 which may be an eight penny stainless steel or galvanized common nail extending through downwardly depending flange 24 of the sill. FIG. 5 also illustrates the end construction of the domes. Thus, the domes 34 and 36 have respective end flanges 34F and 36F. A separate retainer is also provided including retainer member 72 having sections 73 and 74. Section 74 rests upon the top of the flanges 34F and 36F. These flanges are sandwiched between the section 74 of the retainer and an extruded gasket 76. The gasket 76 is held below by means of the channel member 32. A similar gasket could also be provided over the channel member 30. The retainer 72 is held in position by means of a retainer closure cap 75 and one or more round head screws 78 engaged with the sill 12 at wall 28.

The other embodiment of the present invention is illustrated in FIGS. 6 and 7. This embodiment of the invention is substantially the same as the embodiment described in FIGS. 1–6. Thus, in the embodiment of FIG. 6, there is provided a sill 112 and associated dome 110 which is of similar construction to the respective sill 12 and dome 10 shown in FIG. 1. The sill 112 is in particular of the same construction as the sill 12. In the first embodiment, the dome sections may be identical to those shown in the second embodiment at least for the three center sections. In the first embodiment the end sections taper downwardly or are arcuately disposed downwardly toward the end sills. However, in the embodiment of FIG. 6 it is noted that five substantially identical dome sections can be provided with the end dome sections having the structure of FIG. 7 associated therewith. Thus, as illustrated in FIG. 7 there are provided a pair of dome including inner dome 134 and outer dome 136. Again, this skylight is for use about an opening in a building such as the roof 114 illustrated in FIG. 6. A wooden or the like curb 16 in part defines the opening and has on its inner side a finish board 118 which may be plaster or sheet rock. A flashing 120 is also used and is illustrated in both FIGS. 6 and 7. FIG. 6 also illustrates the use of the cap band 154 which may be identical to the cap band 54 as shown in the first embodiment. Also, the complete structure shown in FIG. 4 relating to the intermediate support rib may also be employed in the embodiment illustrated in FIGS. 6 and 7. Because much of this structure is identical to that shown in FIGS. 1–5 it is not repeated in FIGS. 6 and 7. The primary difference in FIGS. 6 and 7 relates to the end structure illustrated in FIG. 7.

Thus, in FIG. 7 there is illustrated a unique end sill construction including sill 90 having a base 91, downwardly depending wall 92, upwardly extending wall 93, and a channel member 94. There is preferably provided a weep hole 95 in wall 93. The base 91 of the sill 90 is secured to the curb by means of an anchoring member 96. A continuous mastic 96 is also provided, applied at the job site by the installer, between the sill and the curb. An extruded channeled gasket 98 is fitted within the channel member 94 and is adapted for supporting the vertically disposed end glazing panels 100 and 101.

The structure illustrated in FIG. 7 also includes an extruded vertical end rib 102 and extruded vertical end cap 103. The end rib 102 is very similar in construction to the intermediate support ribs. A bolt 104 secures the extruded vertical end rib to the extruded vertical end cap. The vertical end rib 102 has a lower flange 105 and a side ear 106. A gasket 107 similar to the aforementioned gaskets 51 and 52 is disposed between the domes 134 and 136. The lower dome 134 rests upon the flange 105.

The extruded vertical end cap 103 includes at one side a channel member 108 for holding the extruded gasket 109. The gasket 109 is channeled to receive the top arcuate side of the vertical glazing panels 100 and 101. The other side of the vertical end cap 103 has a foot 111 supporting a gasket 113 similar to the gaskets 57 and 58 illustrated in FIG. 4.

Having now described a limited number of embodiments of the present invention, numerous other embodiments are contemplated as falling within the scope of this invention.

What is claimed is:

1. A vaulted dome skylight for covering an opening defined by a support curb and comprising:
   - a single piece sill extending about all sides of the support curb,
   - means securing the single piece sill to the support curb,
   - an inner dome means having opposite end flanges,
   - an outer dome means having opposite end flanges,
   - a retaining means for securing the domes over the sill including an end retainer one at each end of the sill having one leg secured to the sill and a second horizontally disposed leg contacting and overlying the dome end flange,
   - said sill having a horizontally disposed base secured to the curb frame and inner and outer angularly disposed channel members for respectively receiving said inner and outer domes along the sides thereof,
   - said inner and outer dome means each comprising a plurality of dome sections with only the end ones thereof having said end flange,
   - at least one intermediate support rib for supporting adjacent dome sections and extending substantially normal to the sill sides, a cap band secured over and to said support rib, a first gasket means disposed at said support rib and between said dome means, a support member and means securing the support member to the sill to maintain the support member in a position to hold the intermediate support rib in place, and a second gasket, one disposed at each end of the sill, arranged intermediate the outer channel member of the sill and the underside of the inner dome end flange.

2. A vaulted dome skylight as set forth in claim 1 wherein each channel member has a U-shaped cross-section with the dome means each having flanges only on the ends leaving the sides free to extend into the respective channel members.

3. A vaulted dome skylight as set forth in claim 2 including a third gasket between the outer dome means and the cap band.

4. A vaulted dome skylight as set forth in claim 3 wherein said support member comprises a post and associated bolt for securing the post from the inner channel member.

5. A vaulted dome skylight as set forth in claim 4 wherein the post is slotted to receive the inner channel member and position the post relative to the sill.

6. A vaulted dome skylight as set forth in claim 5 wherein said second gasket bridges the channel of the outer channel member.

* * * * *